US011270618B2

(12) United States Patent
Yoo et al.

(10) Patent No.: US 11,270,618 B2
(45) Date of Patent: Mar. 8, 2022

(54) APPARATUS FOR TESTING DISPLAY DEVICE AND DISPLAY DEVICE FOR PERFORMING MURA COMPENSATION AND MURA COMPENSATION METHOD

(71) Applicant: Samsung Display Co., Ltd., Yongin-Si (KR)

(72) Inventors: Hyunseuk Yoo, Seoul (KR); Ji-Eun Park, Hwaseong-si (KR); Hye-Sang Park, Cheonan-si (KR); Seokha Hong, Seoul (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/316,483

(22) Filed: May 10, 2021

(65) Prior Publication Data

US 2022/0044608 A1 Feb. 10, 2022

(30) Foreign Application Priority Data

Aug. 6, 2020 (KR) ..... 10-2020-0098784

(51) Int. Cl.
*G09G 3/20* (2006.01)
*G09G 3/00* (2006.01)

(52) U.S. Cl.
CPC ..... *G09G 3/20* (2013.01); *G09G 3/006* (2013.01); *G09G 2310/0278* (2013.01); *G09G 2320/0233* (2013.01); *G09G 2360/16* (2013.01)

(58) Field of Classification Search
CPC .. G09G 3/20; G09G 3/006; G09G 2310/0278; G09G 2320/0233; G09G 2360/16
See application file for complete search history.

(56) References Cited

U.S. PATENT DOCUMENTS

| | | | | |
|---|---|---|---|---|
| 2015/0116387 | A1 | 4/2015 | Jun et al. | |
| 2020/0265804 | A1* | 8/2020 | Chen | G09G 5/18 |
| 2020/0265877 | A1* | 8/2020 | Zheng | G09G 3/20 |
| 2020/0267359 | A1* | 8/2020 | Seiler | G09G 5/14 |

FOREIGN PATENT DOCUMENTS

| | | | |
|---|---|---|---|
| KR | 10-2015-0048394 | A | 5/2015 |
| KR | 10-2017-0003226 | A | 1/2017 |
| KR | 10-2017-0023614 | A | 3/2017 |

* cited by examiner

*Primary Examiner* — Sejoon Ahn
(74) *Attorney, Agent, or Firm* — Innovation Counsel LLP

(57) ABSTRACT

A test apparatus includes: a compensation coefficient calculator configured to calculate a main compensation coefficient for a main gradation and a sub compensation coefficient for a sub gradation based on a detected image signal; a primary predictor configured to determine a representative value of each of a plurality of blocks of a display panel based on the detected image signal, and output a prediction compensation coefficient for the sub gradation based on the main compensation coefficient and the representative value corresponding to each of the plurality of blocks; a secondary predictor configured to determine a flag based on the sub compensation coefficient and the prediction compensation coefficient; and a controller configured to output the main compensation coefficient, the representative value, and the flag stored in a memory as compensation data.

20 Claims, 8 Drawing Sheets

APPARATUS FOR TESTING DISPLAY DEVICE AND DISPLAY DEVICE FOR PERFORMING MURA COMPENSATION AND MURA COMPENSATION METHOD

CROSS-REFERENCE TO RELATED APPLICATIONS

This U.S. non-provisional patent application claims priority under 35 U.S.C. § 119 of Korean Patent Application No. 10-2020-0098784, filed on Aug. 6, 2020, the disclosure of which is hereby incorporated by reference in its entirety.

BACKGROUND

The present disclosure relates to a display device capable of performing mura compensation and an apparatus for testing a display device.

Multimedia electronic devices such as televisions, mobile phones, tablet computers, navigation devices, game machines, and the like are provided with a display device for displaying an image. The display device includes a plurality of pixels for displaying the image. The plurality of pixels may have different characteristics due to a process deviation even if the pixels are formed through the same manufacturing process. As a result, some of the pixels provided with an image signal having the same gradation may output light at different luminance levels, causing a degradation of the display quality such as an mura effect.

SUMMARY

The present disclosure provides a test apparatus that tests a characteristic difference among pixels and a display device which performs mura compensation.

According to an embodiment of the present disclosure, a test apparatus includes: a compensation coefficient calculator configured to calculate a main compensation coefficient for a main gradation and a sub compensation coefficient for a sub gradation based on a detected image signal; a primary predictor configured to divide a display panel into a plurality of blocks, determine a representative value of each of the plurality of blocks based on the detected image signal, and output a prediction compensation coefficient for the sub gradation based on the main compensation coefficient and the representative value corresponding to each of the plurality of blocks; a secondary predictor configured to determine a flag based on the sub compensation coefficient received from the compensation coefficient calculator and the prediction compensation coefficient received from the primary predictor; a memory configured to store the main compensation coefficient and the flag; and a controller configured to output compensation data comprising the main compensation coefficient, the representative value, and the flag stored in the memory.

In an embodiment, the representative value may include a main mean and a main standard deviation corresponding to the main gradation of each of the plurality of blocks and a sub mean and a sub standard deviation corresponding to the sub gradation of each of the plurality of blocks.

In an embodiment, the controller may determine a compensation value corresponding to the flag based on the standard deviation corresponding to the sub gradation, and the compensation data may further include the compensation value.

In an embodiment, the compensation value may minimize a mean squared error corresponding to the prediction compensation coefficient.

In an embodiment, the compensation value may be $$\frac{2\sigma}{\sqrt{2\pi}},$$

where σ denotes the sub standard deviation corresponding to the sub gradation.

In an embodiment, a width of the flag may be 1 bit, and in a case where the prediction compensation coefficient is less than the sub compensation coefficient, the flag may be 1, and the compensation value may be a positive number.

In an embodiment, a width of the flag may be 1 bit, and in a case where the prediction compensation coefficient is larger the sub compensation coefficient, the flag may be 0, and the compensation value may be a negative number.

In an embodiment, the prediction compensation coefficient for the sub gradation may be denoted as x' and obtained using an equation $$x' = \frac{x_0 - \mu_0}{\sigma_0} \times \sigma_1 + \mu_1,$$

where $x_0$, $\mu_0$, and $\sigma_0$ denote the main compensation coefficient, the main mean, and the main standard deviation corresponding to the main gradation of a pixel, and $\mu_1$ and $\sigma_1$ denote the sub mean and the sub standard deviation corresponding to the sub gradation of the pixel.

According to an embodiment of the present disclosure, a display device includes: a display panel including a plurality of pixels connected to a plurality of data lines and a plurality of scan lines; a data driving circuit configured to drive the plurality of data lines; a scan driving circuit configured to drive the plurality of scan lines; a memory configured to store compensation data; and a driving controller configured to receive a control signal and an input image signal, control the data driving circuit and the scan driving circuit to display an image on the display panel, and provide, to the data driving circuit, an image data signal obtained by correcting the input image signal based on the compensation data. The compensation data includes a main compensation coefficient for a main gradation, a representative value for the main gradation, a representative value for a sub gradation, and a flag and a compensation value for the sub gradation.

In an embodiment, the driving controller may output the image data signal based on the main compensation coefficient in a case where the input image signal corresponds to the main gradation.

In an embodiment, in a case where the input image signal does not correspond to the main gradation, the driving controller may determine a prediction compensation coefficient based on the main compensation coefficient, the representative value for the main gradation, the representative value for the sub gradation, the flag, and the compensation value, and output the image data signal based on the prediction compensation coefficient.

In an embodiment, in a case where the input image signal corresponds to the sub gradation, the driving controller may determine the prediction compensation coefficient denoted as G' using an equation $$G = \frac{G_0 - \mu_0}{\sigma_0} \times \sigma_1 + \mu_1,$$

where $G_0$, $\mu_0$, and $\sigma_0$ denote the main compensation coefficient, a main mean, and a main standard deviation corresponding to the main gradation, and $\mu_1$ and $\sigma_1$ denote a sub mean and a sub standard deviation corresponding to the input image signal.

In an embodiment, the driving controller may output the image data signal by adding the compensation value to the prediction compensation coefficient.

According to an embodiment of the present disclosure, a mura compensation method of a display device includes: receiving a detected image signal for a main gradation and determining a main compensation coefficient for the main gradation; receiving the detected image signal for a sub gradation and determining a sub compensation coefficient for the sub gradation; performing primary prediction by dividing a display panel into a plurality of blocks, determining a representative value for each of the plurality of blocks, and determining a prediction compensation coefficient for the sub gradation based on the representative value and the main compensation coefficient; performing secondary prediction by determining a flag based on the sub compensation coefficient and the prediction compensation coefficient; providing compensation data including the main compensation coefficient, the representative value, and the flag; and providing an image signal that is obtained by correcting an input image signal based on the compensation data, and displaying an image based on the image signal.

In an embodiment, the representative value may include a main mean and a main standard deviation corresponding to the main gradation of each of the plurality of blocks and a sub mean and a sub standard deviation corresponding to the sub gradation of each of the plurality of blocks.

In an embodiment, the outputting of the compensation data may include determining a compensation value corresponding to the flag based on the sub standard deviation corresponding to the sub gradation, and the compensation data may further include the compensation value.

In an embodiment, the compensation value may minimize a mean squared error corresponding to the prediction compensation coefficient.

In an embodiment, the compensation value may be $$\frac{2\sigma}{\sqrt{2\pi}},$$

where $\sigma$ denotes the sub standard deviation corresponding to the sub gradation.

In an embodiment, a width of the flag may be 1 bit, and the performing of the secondary prediction may include: setting the flag to 1 in a first case where the prediction compensation coefficient is less than the sub compensation coefficient; and setting the flag to 0 in a second case the prediction compensation coefficient is larger than the sub compensation coefficient.

In an embodiment, the prediction compensation coefficient for the sub gradation may be denoted as x' and obtained using an equation $$x' = \frac{x_0 - \mu_0}{\sigma_0} \times \sigma_1 + \mu_1,$$

where $x_0$, $\mu_0$, and $\sigma_0$ denote the main compensation coefficient, the main mean, and the main standard deviation corresponding to the main gradation of a pixel, and $\mu_1$ and $\sigma_1$ denote the sub mean and the sub standard deviation corresponding to the sub gradation of the pixel.

BRIEF DESCRIPTION OF THE FIGURES

The drawings are included to provide further understanding of the present disclosure. The drawings are incorporated in and constitute a part of this specification, illustrate various embodiments of the present disclosure, and together with the description serve to explain principles of the inventive concept of the present disclosure. In the drawings.

DETAILED DESCRIPTION

Figure 1:
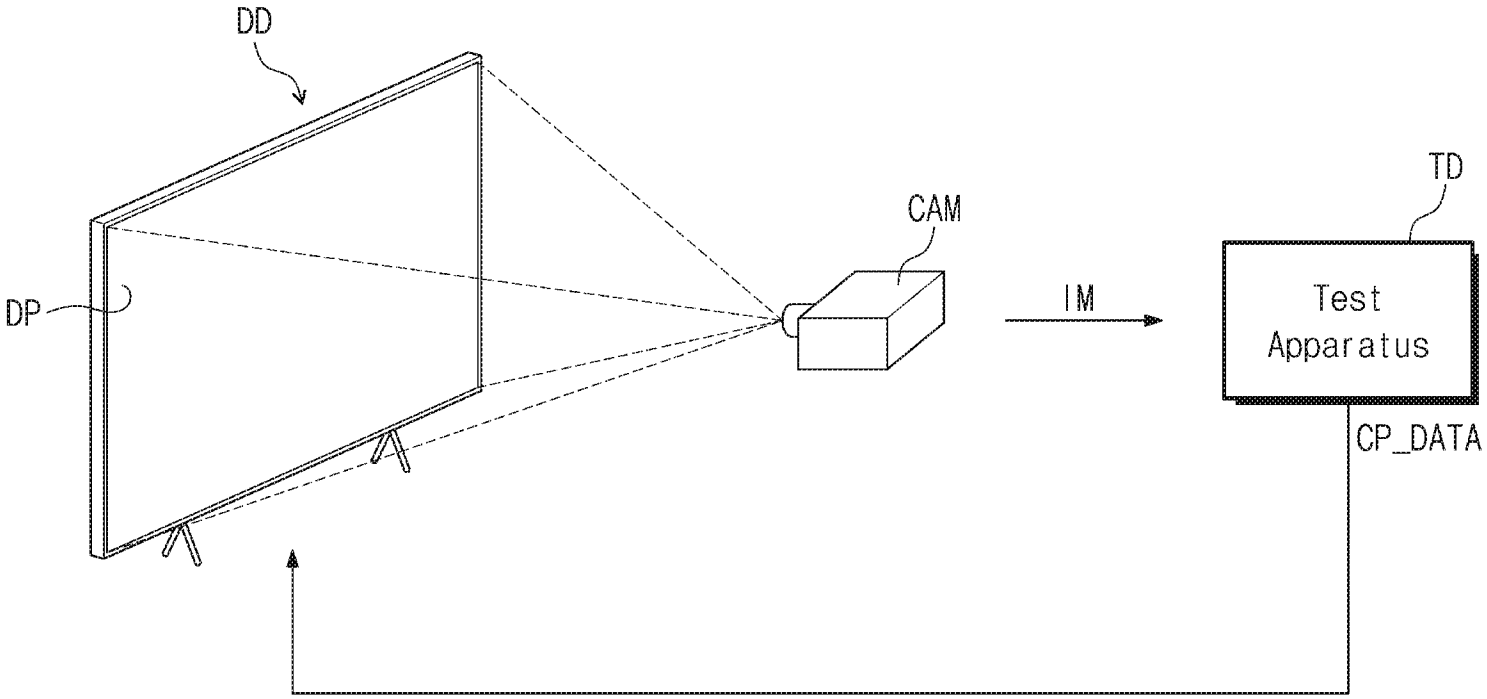
FIG. 1 illustrates a test system for testing a display device according to an embodiment.

It will be understood that an element (or a region, layer, portion, or the like) referred to as being "on," "connected to," or "coupled to" another element can be directly on or directly connected/coupled to the other element, or a third element may be present therebetween.

The same reference numerals may refer to the same elements. In the drawings, the thicknesses, ratios, and dimensions of elements may be exaggerated for clarity of illustration. As used herein, the term "and/or" includes any combinations that can be defined by associated elements.

The terms "first," "second," and the like may be used for describing various elements, but the elements should not be construed as being limited by the terms. Such terms are only used for distinguishing one element from other elements. For example, a first element could be termed a second element and vice versa without departing from the teachings of the present disclosure. The terms of a singular form may include plural forms unless specifically specified otherwise.

Furthermore, the terms "under," "lower side," "on," "upper side," and the like are used to describe association relationships among elements illustrated in the drawings. The relative terms may be used based on directions illustrated in the drawings.

It will be further understood that the terms "include," "including," "has," "having," and the like, when used in this specification, specify the presence of stated features, numbers, steps, operations, elements, components, or combinations thereof, but do not preclude a presence or an addition of one or more other features, numbers, steps, operations, elements, components, or combinations thereof.

The terms used herein (including technical and scientific terms) are assumed to have the same meanings as understood by those skilled in the art, unless specifically defined otherwise. Terms in common usage such as those defined in commonly used dictionaries should be interpreted to contextually cover the meanings in the relevant art, and should not be interpreted in an idealized or overly formal sense.

Hereinafter, embodiments of the present disclosure will be described in detail with reference to the accompanying drawings.

FIG. 1 illustrates a test system for testing a display device according to an embodiment.

Referring to FIG. 1, the test system includes a display device DD, a camera CAM, and a test apparatus TD. FIG. 1 illustrates a television as an example of the display device DD, but the present disclosure is not limited thereto. The display device DD may include large-size electronic devices such as a television or an outdoor billboard as well as small- and medium-size electronic devices such as a personal computer (PC), a notebook computer, a kiosk, a vehicle navigation unit, a camera, a tablet PC, a smartphone, a personal digital assistant (PDA), a portable multimedia player (PMP), a game machine, a watch-type electronic device, and the like.

As illustrated in FIG. 1, the camera CAM captures an image displayed on a display panel DP of the display device DD and provides a detected image signal IM to the test apparatus TD. The test apparatus TD detects luminance of the pixels of the display device DD based on the detected image signal IM and generates compensation data CP_DATA. The compensation data CP_DATA may be provided to the display device DD, and the display device DD may compensate an image signal based on the compensation data CP_DATA to generate a compensated image signal, and may display the image based on the compensated image signal.

Although FIG. 1 illustrates the camera CAM and the test apparatus TD as independent devices, the camera CAM and the test apparatus TD may be implemented in a single electronic device. For example, the camera CAM may be an element of the test apparatus TD.

Figure 2:
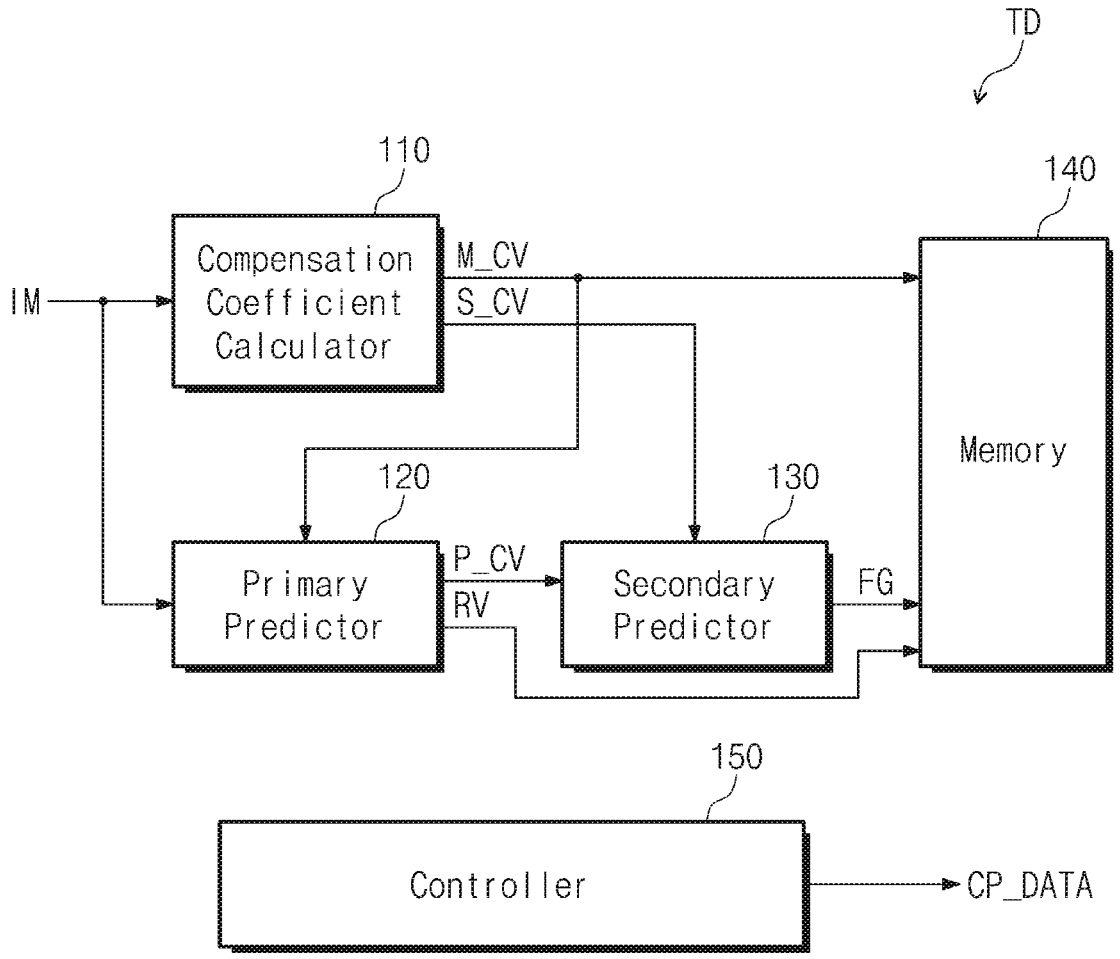
FIG. 2 is a block diagram of a test apparatus according to an embodiment.

FIG. 2 is a block diagram of the test apparatus TD according to an embodiment.

Referring to FIGS. 1 and 2, the test apparatus TD includes a compensation coefficient calculator 110, a primary predictor 120, a secondary predictor 130, a memory 140, and a controller 150.

The compensation coefficient calculator 110 receives the detected image signal IM and calculates a main compensation coefficient M_CV for a main gradation and a sub compensation coefficient S_CV for a sub gradation based on the detected image signal IM.

The primary predictor 120 receives the detected image signal IM and divides the display panel DP of the display device DD into a plurality of blocks and calculates a representative value RV of each of the plurality of blocks based on the detected image signal IM. The primary predictor 120 outputs a prediction compensation coefficient P_CV based on the main compensation coefficient M_CV and the representative value RV corresponding to each of the plurality of blocks.

The secondary predictor 130 receives the prediction compensation coefficient P_CV and determines a flag FG based on the sub compensation coefficient S_CV and the prediction compensation coefficient P_CV.

The memory 140 stores the main compensation coefficient M_CV received from the compensation coefficient calculator 110, the representative value RV received from the primary predictor 120, and the flag FG received from the secondary predictor 130.

The controller 150 outputs, as the compensation data CP_DATA, the main compensation coefficient M_CV, the representative value RV, and the flag FG stored in the memory 140. The controller 150 may control operation of the compensation coefficient calculator 110, the primary predictor 120, and/or the secondary predictor 130. Furthermore, the controller 150 may control operation of the camera CAM of FIG. 1.

Specific operation of each of elements of the test apparatus TD is described in detail below.

Figure 3:
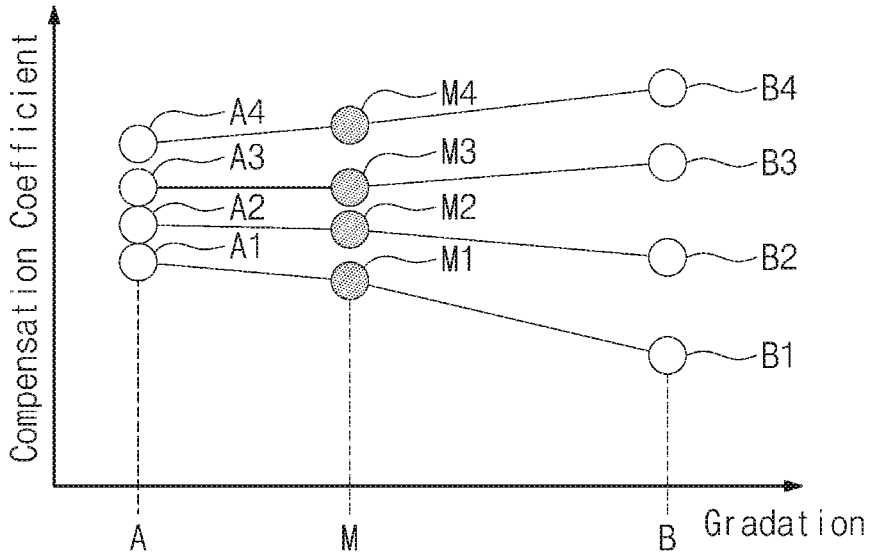
FIG. 3 illustrates a compensation coefficient and prediction luminance according to luminance of a pixel detected by a test apparatus.

FIG. 3 illustrates a compensation coefficient and prediction luminance according to luminance of a pixel detected by the test apparatus TD.

Referring to FIGS. 1, 2, and 3, the display device DD includes a plurality of pixels. The plurality of pixels may have different characteristics, for example, due to a process deviation even if the pixels are formed through the same manufacturing process. For example, some of the pixels provided with an image signal having the same gradation may output light at different luminance levels.

For example, the display device DD may provide, to the pixels, an image data signal corresponding to a main gradation M, and the camera CAM may detect an image in which the pixels may have different values of luminance according to the characteristics of the pixels. The compensation coefficient calculator 110 included in the test apparatus TD may generate different compensation coefficients M1, M2, M3, and M4 based on the detected image signal IM received from the camera CAM.

In general, a pixel has a regular tendency according to a gradation. For example, a pixel that outputs lower luminance than desired luminance at the main gradation M may output lower luminance than desired luminance at a sub gradation A that is lower than the main gradation M, and may also output lower luminance than desired luminance at a sub gradation B that is higher than the main gradation M.

For another example, a pixel that outputs higher luminance than desired luminance at the main gradation M may output higher luminance than desired luminance at the sub gradation A that is lower than the main gradation M, and may also output higher luminance than desired luminance at the sub gradation B that is higher than the main gradation M.

The compensation coefficient calculator 110 may set a compensation coefficient of a pixel to a lower value when the luminance of the pixel is higher than desired luminance and may set a compensation coefficient of a pixel to a higher value when the luminance of the pixel is lower than desired luminance. In the example illustrated in FIG. 3, the gradations may be such that A<M<B. The main compensation coefficients M_CV for the main gradation M may be such that M1<M2<M3<M4. The prediction compensation coefficients P_CV for the sub gradation A may be such that A1<A2<A3<A4, and the prediction compensation coefficients P_CV for the sub gradation B may be such that B1<B2<B3<B4.

For a pixel having the main compensation coefficient M1 at the gradation M, the prediction compensation coefficient may be predicted to be A1 at the gradation A and predicted to be B1 at the gradation B. For a pixel having the main compensation coefficient M2 at the gradation M, the prediction compensation coefficient may be predicted to be A2 at the gradation A and predicted to be B2 at the gradation B. For a pixel having the main compensation coefficient M3 at the gradation M, the prediction compensation coefficient may be predicted to be A3 at the gradation A and predicted to be B3 at the gradation B. For a pixel having the main compensation coefficient M4 at the gradation M, the prediction compensation coefficient may be predicted to be A4 at the gradation A and predicted to be B4 at the gradation B.

The compensation coefficient calculator 110 of the test apparatus TD may calculate each of the main compensation coefficient M_CV for the main gradation M and the sub compensation coefficient S_CV for one or more sub gradations (e.g., gradation A, gradation B) based on the detected image signal IM. Furthermore, the primary predictor 120 of the test apparatus TD may calculate the prediction compensation coefficient P_CV for the sub gradation (e.g., gradation A and gradation B) based on the main compensation coefficient M_CV.

Figure 4:
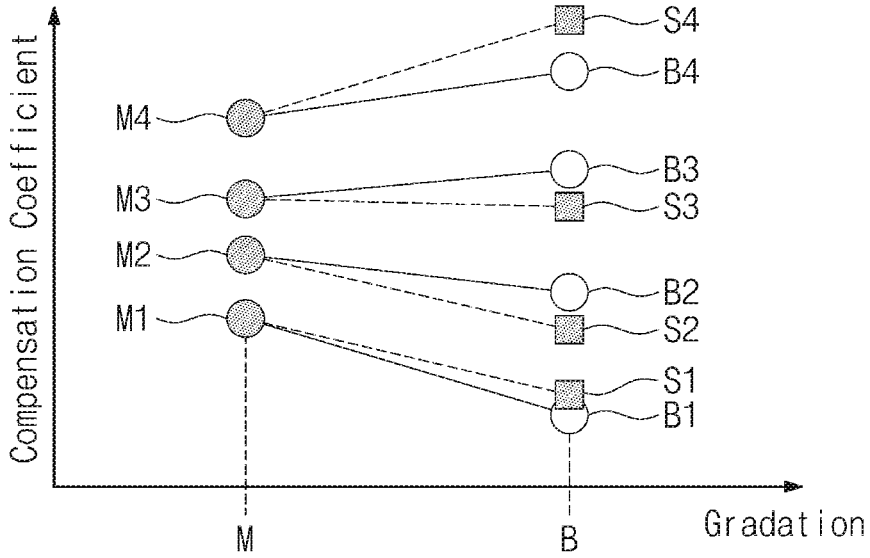
FIG. 4 illustrates sub compensation coefficients and prediction compensation coefficients predicted by a test apparatus TD.

FIG. 4 illustrates sub compensation coefficients S_CV and prediction compensation coefficients P_CV predicted by the test apparatus TD.

Referring to FIGS. 2 and 4, the prediction compensation coefficients P_CV, i.e., B1, B2, B3, and B4, for the sub gradation B that are output from the primary predictor 120 may not match the sub compensation coefficients S_CV, i.e., S1, S2, S3, and S4 that are output from the compensation coefficient calculator 110. The secondary predictor 130 may output the flag FG for reducing an error between the prediction compensation coefficient P_CV and the sub compensation coefficient S_CV.

Figure 5:
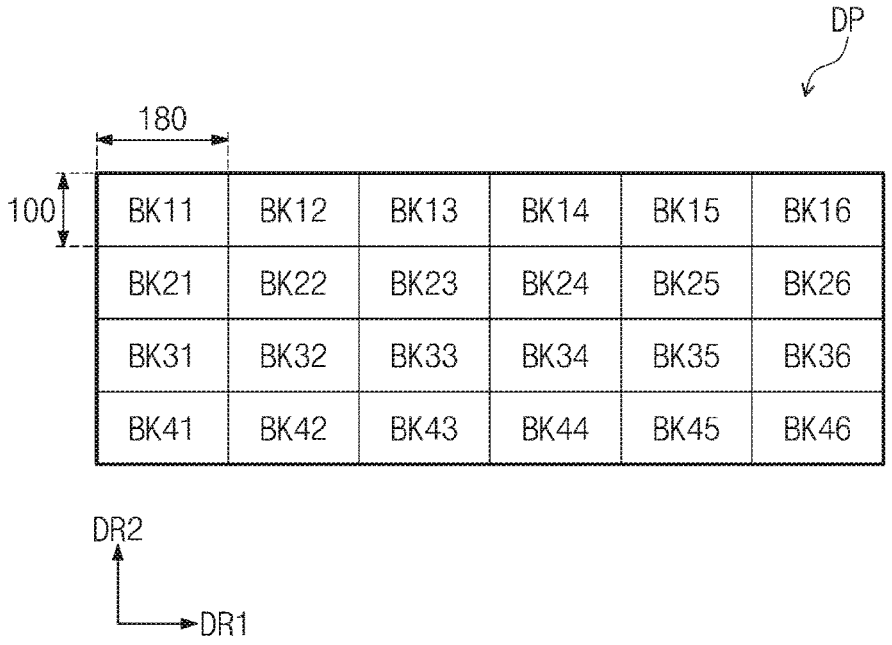
FIG. 5 illustrates an example in which a display panel is divided into a plurality of blocks according to an embodiment.

FIG. 5 illustrates an example in which the display panel DP is divided into a plurality of blocks according to an embodiment.

Referring to FIG. 5, the display panel DP may be divided into blocks BK11-BK16, BK21-BK26, BK31-BK36, and BK41-BK46. FIG. 5 illustrates the display panel DP divided into six blocks in a first direction DR1 and four blocks in a second direction DR2, but the number of blocks dividing the display panel DP may be variously changed without deviating from the scope of the present disclosure.

Referring to FIGS. 2, 3, and 5, the primary predictor 120 may divide the display panel DP of the display device DD into a plurality of blocks and calculate the representative value RV of each of the plurality of blocks based on the detected image signal IM for each of the plurality of blocks. In this embodiment, the representative value RV may include a mean and a standard deviation of the blocks BK11-BK16, BK21-BK26, BK31-BK36, and BK41-BK46. However, the representative value RV is not limited thereto, and may include a median and a mode in another embodiment.

Each of the blocks BK11-BK16, BK21-BK26, BK31-BK36, and BK41-BK46 may include 180 pixels in the first direction DR1 and 100 pixels in the second direction DR2. The number of pixels included in one block, or a size of each block, may be variously changed without deviating from the scope of the present disclosure.

Figure 6:
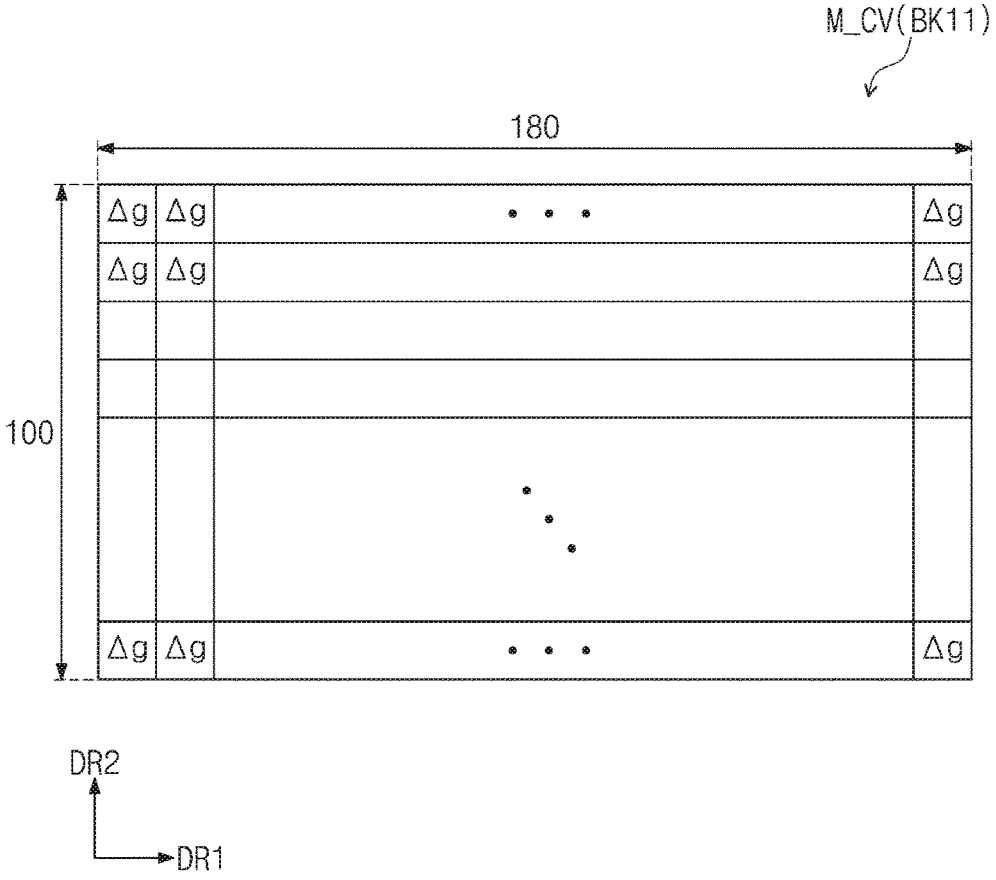
FIG. 6 illustrates a main compensation coefficient stored in a memory of the test apparatus illustrated in FIG. 2.

FIG. 6 illustrates the main compensation coefficient M_CV stored in the memory 140 of the test apparatus TD illustrated in FIG. 2.

Although FIG. 6 illustrates only the main compensation coefficient M_CV corresponding to the block BK11 illustrated in FIG. 5 as an example, it is understood that the memory 140 may also store the main compensation coefficients corresponding to the other blocks BK12-BK16, BK21-BK26, BK31-BK36, and BK41-BK46.

Referring to FIG. 6, the main compensation coefficient M_CV corresponding to the block BK11 may include compensation coefficients corresponding to 180 pixels in the first direction DR1 and 100 pixels in the second direction DR2 in the block BK11. The compensation coefficients may be a difference value Δg between the main gradation M and detected luminance of the corresponding pixel in the detected image signal IM.

Figure 7:
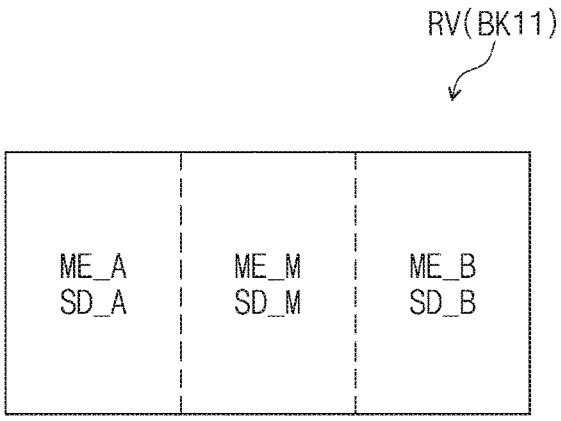
FIG. 7 illustrates a representative value stored in the memory of the test apparatus illustrated in FIG. 2.

FIG. 7 illustrates the representative value RV stored in the memory 140 of the test apparatus TD illustrated in FIG. 2.

Although FIG. 7 only illustrates the representative value RV corresponding to the block BK11 illustrated in FIG. 5, the memory 140 may also store the representative values RV corresponding to the other blocks BK12-BK16, BK21-BK26, BK31-BK36, and BK41-BK46.

The primary predictor 120 may calculate the representative values RV corresponding to each of the plurality of blocks. The representative value RV corresponding to the block BK11 may include a mean ME_M and a standard deviation SD_M corresponding to the main gradation M, a mean ME_A and a standard deviation SD_A corresponding to the sub gradation A, and a mean ME_B and a standard deviation SD_B corresponding to the sub gradation B.

Although FIG. 7 illustrates that the representative values RV of two sub gradations corresponding to one block BK11 are stored, the present disclosure is not limited thereto. The number of sub gradations corresponding to one block BK11 may be variously changed without deviating from the scope of the present disclosure.

The primary predictor 120 may output the prediction compensation coefficient P_CV corresponding to each of pixels in a block based on the main compensation coefficient M_CV and output the representative value RV corresponding to each of the blocks BK11-BK16, BK21-BK26, BK31-BK36, and BK41-BK46.

For example, the prediction compensation coefficient P_CV may be calculated through following Equation 1.

$$x' = \frac{x_0 - \mu_0}{\sigma_0} \times \sigma_1 + \mu_1 \quad \text{(Equation 1)}$$

In Equation 1, $x_0$, $\mu_0$, and $\sigma_0$ respectively denote the main compensation coefficient M_CV, a mean, and a standard deviation corresponding to a main gradation of a pixel, and x', $\mu_1$, and $\sigma_1$ respectively denote the prediction compensation coefficient P_CV, a mean, and a standard deviation corresponding to a sub gradation (e.g., the sub gradation A, the sub gradation B) of the pixel.

The secondary predictor 130 may determine the flag FG based on the sub compensation coefficient S_CV that is received from the compensation coefficient calculator 110 and the prediction compensation coefficient P_CV that is received from the primary predictor 120.

As described above with reference to FIG. 4, the prediction compensation coefficients P_CV, i.e., B1, B2, B3, and B4, for the sub gradation B that are output from the primary predictor 120 may not match the sub compensation coefficients S_CV, i.e., S 1, S2, S3, and S4, that are output from the compensation coefficient calculator 110.

According to an embodiment, the secondary predictor 130 may determine the flag FG corresponding to a difference between the sub compensation coefficient S_CV and the prediction compensation coefficient P_CV. The flag FG output from the secondary predictor 130 may be stored in the memory 140.

As illustrated in FIG. 5, the primary predictor 120 divides the display panel DP into the blocks BK11-BK16, BK21-BK26, BK31-BK36, and BK41-BK46, calculates the representative value RV for each block, and then outputs the prediction compensation coefficient P_CV based on the representative value RV, thereby performing block-wise prediction.

The secondary predictor 130 may perform pixel-wise prediction for calculating a flag bit B corresponding to each pixel based on the prediction compensation coefficient P_CV received from the primary predictor 120.

Figure 8:
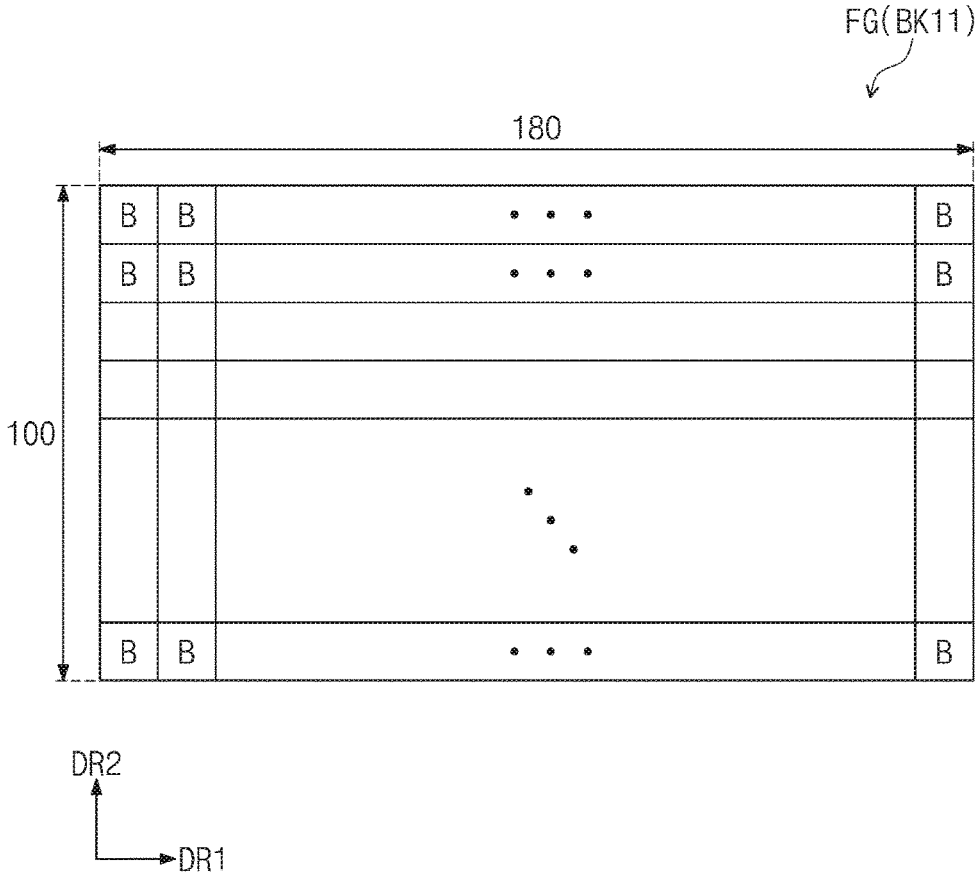
FIG. 8 illustrates a flag stored in the memory of the test apparatus illustrated in FIG. 2.

FIG. 8 illustrates the flag FG stored in the memory 140 of the test apparatus TD illustrated in FIG. 2.

Although FIG. 8 illustrates only the flag FG corresponding to the block BK11 illustrated in FIG. 5, it is understood that the memory 140 may also store the flags FG corresponding to the other blocks BK12-BK16, BK21-BK26, BK31-BK36, and BK41-BK46.

Referring to FIGS. 2 and 8, the flag FG corresponding to the block BK11 may include flag bits B corresponding to 180 pixels in the first direction DR1 and 100 pixels in the second direction DR2 in the block BK11. A bit width of the flag bit B may be one or greater.

In one embodiment, the bit width of the flag bit B corresponding to a predetermined pixel is one bit, and the flag bit B may be 1 or 0 according to the difference between the sub compensation coefficient S_CV and the prediction compensation coefficient P_CV.

For example, when the prediction compensation coefficient P_CV is 10 and the sub compensation coefficient S_CV that is calculated by the compensation coefficient calculator 110 is 14, a compensation value β is added to the prediction compensation coefficient P_CV (10+β). When the prediction compensation coefficient P_CV is less than the sub compensation coefficient S_CV (P_CV<S_CV), i.e., when the compensation value β is a positive number, the flag bit B may be 1.

On the contrary, when the prediction compensation coefficient P_CV is 10 and the sub compensation coefficient S_CV that is calculated by the compensation coefficient calculator 110 is 5, the compensation value β is subtracted from the prediction compensation coefficient P_CV (10−β). As described above, when the prediction compensation coefficient P_CV is larger than the sub compensation coefficient S_CV (P_CV>S_CV), i.e., when the compensation value β is a negative number, the flag bit B may be 0.

Figure 9:
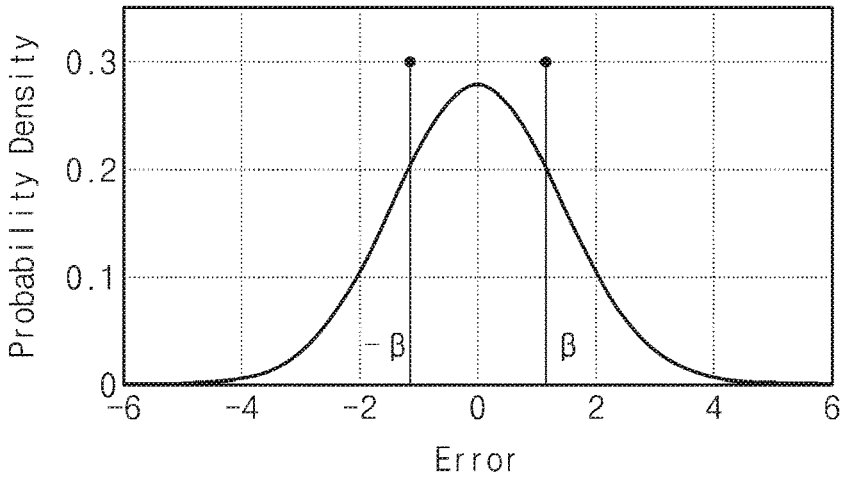
FIG. 9 is a graph illustrating a probability density pertaining to an error between a prediction compensation coefficient and a sub compensation coefficient.

FIG. 9 is a graph illustrating a probability density pertaining to an error between the prediction compensation coefficient P_CV and the sub compensation coefficient S_CV.

Referring to FIGS. 2 and 9, when the sub compensation coefficient S_CV for the sub gradation B is $\Delta g_B$, and the prediction compensation coefficient P_CV is $\Delta g'_B$, an error N between the sub compensation coefficient S_CV and the prediction compensation coefficient P_CV may be expressed as Equation 2.

$$N \triangleq \Delta g_B - \Delta'_B \quad \text{(Equation 2)}$$

In the example illustrated in FIG. 9, the probability density pertaining to the error N may have a Gaussian distribution characteristic. Here, when an optimum compensation value (+β, −β) is obtained, the controller 150 may calculate a final compensation value for a sub gradation (e.g., the sub gradation A, the sub gradation B) by adding a compensation value (+β, −β) corresponding to the flag bit B to the prediction compensation coefficient P_CV.

A final compensation value $\Delta g''_B$ may be determined by following Equation 3.

$$\Delta g''_B = \begin{cases} \Delta g'_B + \beta, & \text{if } \Delta g_B \geq \Delta g'_B \\ \Delta g'_B - \beta, & \text{if } \Delta g_B < \Delta g'_B \end{cases} \quad \text{(Equation 3)}$$

The compensation value β may be determined to minimize a mean squared error (MSE).

Equation 4 expresses an MSE for calculating the compensation value β.

Hereinafter, x denotes the prediction compensation coefficient P_CV for the sub gradation B, and G denotes a standard deviation for the sub gradation B.

$$MSE \triangleq \int_{-\infty}^{0} (x+\beta)^2 f_G(x)dx + \int_{0}^{\infty} (x-\beta)^2 f_G(x)dx \quad \text{(Equation 4)}$$

In Equation 4, $f_G(x)$ may be expressed as Equation 5.

$$f_G(x) = \frac{1}{\sqrt{2\pi}\,\sigma}\exp\left(-\frac{x^2}{2\sigma^2}\right) \quad \text{(Equation 5)}$$

In Equation 4, when the term $$\int_{-\infty}^{0} (x+\beta)^2 f_G(x)dx$$

is referred to as $M_1$, $M_1$ may be expressed as Equation 6.

$$M_1 = \int_{-\infty}^{0} x^2 \frac{1}{\sqrt{2\pi}\,\sigma}\exp\left(-\frac{x^2}{2\sigma^2}\right)dx + \int_{-\infty}^{0} 2\beta x \frac{1}{\sqrt{2\pi}\,\sigma}\exp\left(-\frac{x^2}{2\sigma^2}\right)dx + \int_{-\infty}^{0} \beta^2 \frac{1}{\sqrt{2\pi}\,\sigma}\exp\left(-\frac{x^2}{2\sigma^2}\right)dx \quad \text{(Equation 6)}$$

In Equation 6, when $$\int_{-\infty}^{0} x^2 \frac{1}{\sqrt{2\pi}\,\sigma}\exp\left(-\frac{x^2}{2\sigma^2}\right)dx$$

is referred to as $M_{1A}$ and y substitutes for x/σ, $M_{1A}$ may be expressed as Equation 7.

$$M_{1A} = \frac{1}{\sqrt{2\pi}\,\sigma}\int_{-\infty}^{0} \sigma^2 y^2 \exp\left(-\frac{y^2}{2}\right)\cdot\sigma dy \quad \text{(Equation 7)}$$

-continued $$= \frac{\sigma^2}{\sqrt{2\pi}} \int_{-\infty}^{0} y \cdot y \exp\left(-\frac{y^2}{2}\right) dy$$

$$= \left[-\frac{\sigma^2}{\sqrt{2\pi}} y \cdot \exp\left(-\frac{y^2}{2}\right)\right]_{-\infty}^{0} + [\sigma^2\{1 - Q(y)\}]_{-\infty}^{0}$$

In Equation 7, when $$\left[-\frac{\sigma^2}{\sqrt{2\pi}} y \cdot \exp\left(-\frac{y^2}{2}\right)\right]_{-\infty}^{0}$$

is 0, $M_{1A}$ may be $\sigma^2/2$.

In Equation 6, when $$\int_{-\infty}^{0} 2\beta x \frac{1}{\sqrt{2\pi}\,\sigma} \exp\left(-\frac{x^2}{2\sigma^2}\right) dx$$

is referred to as $M_{1B}$ and y substitutes for x/σ, $M_{1B}$ may be expressed as Equation 8.

$$M_{1B} = \frac{2\beta}{\sqrt{2\pi}\,\sigma} \int_{-\infty}^{0} \sigma y \cdot \exp\left(-\frac{y^2}{2}\right) \cdot \sigma dy \quad \text{(Equation 8)}$$

$$= \frac{2\beta\sigma}{\sqrt{2\pi}} \int_{-\infty}^{0} y \cdot \exp\left(-\frac{y^2}{2}\right) dy$$

$$= \left[-\frac{2\beta\sigma}{\sqrt{2\pi}} \exp\left(-\frac{y^2}{2}\right)\right]_{-\infty}^{0} = -\frac{2\sigma\beta}{\sqrt{2\pi}}$$

In Equation 6, when $$\int_{-\infty}^{0} \beta^2 \frac{1}{\sqrt{2\pi}\,\sigma} \exp\left(-\frac{x^2}{2\sigma^2}\right) dx$$

is referred to as $M_{1C}$ and y substitutes for x/σ, $M_{1C}$ may be expressed as Equation 9.

$$M_{1C} = \frac{\beta^2}{\sqrt{2\pi}\,\sigma} \int_{-\infty}^{0} \exp\left(-\frac{y^2}{2}\right) \sigma \mathrm{dy} \quad \text{(Equation 9)}$$

$$= [\beta^2 \cdot \{1 - Q(y)\}]_{-\infty}^{0} = \frac{\beta^2}{2}$$

$$\text{where} \quad Q(x) \triangleq \frac{1}{\sqrt{2\pi}} \int_{x}^{\infty} \exp\left(-\frac{u^2}{2}\right) du$$

In Equation 4, when $$\int_{0}^{\infty} (x - \beta)^2 f_G(x) dx$$

is referred to as $M_2$, $M_2$ may be expressed as Equation 10.

$$M_2 = \int_{0}^{\infty} x^2 \frac{1}{\sqrt{2\pi}\,\sigma} \exp\left(-\frac{x^2}{2\sigma^2}\right) dx - 2\beta \int_{0}^{\infty} x \frac{1}{\sqrt{2\pi}\,\sigma} \exp\left(-\frac{x^2}{2\sigma^2}\right) dx + \int_{0}^{\infty} \beta^2 \frac{1}{\sqrt{2\pi}\,\sigma} \exp\left(-\frac{x^2}{2\sigma^2}\right) dx \quad \text{(Equation 10)}$$

In Equation 10, when $$\int_{0}^{\infty} x^2 \frac{1}{\sqrt{2\pi}\,\sigma} \exp\left(-\frac{x^2}{2\sigma^2}\right) dx$$

is referred to as $M_{2A}$, $M_{2A}$ may be expressed as Equation 11.

$$M_{2A} = \left[-\frac{\sigma^2}{\sqrt{2\pi}} y \cdot \exp\left(-\frac{y^2}{2}\right)\right]_{0}^{\infty} + [\sigma^2\{1 - Q(y)\}]_{0}^{\infty} \quad \text{(Equation 11)}$$

In Equation 11, when $$\left[-\frac{\sigma^2}{\sqrt{2\pi}} y \cdot \exp\left(-\frac{y^2}{2}\right)\right]_{0}^{\infty}$$

is 0, $M_{2A}$ is $\sigma^2/2$.

In Equation 10, when $$2\beta \int_{0}^{\infty} x \frac{1}{\sqrt{2\pi}\,\sigma} \exp\left(-\frac{x^2}{2\sigma^2}\right) dx$$

is referred to as $M_{2B}$, $M_{2B}$ may be expressed as Equation 12.

$$M_{2B} = \left[\frac{2\beta\sigma}{\sqrt{2\pi}} \exp\left(-\frac{y^2}{2}\right)\right]_{0}^{\infty} = -\frac{2\sigma\beta}{\sqrt{2\pi}} \quad \text{(Equation 12)}$$

In Equation 10, when $$\int_{0}^{\infty} \beta^2 \frac{1}{\sqrt{2\pi}\,\sigma} \exp\left(-\frac{x^2}{2\sigma^2}\right) dx$$

is referred to as $M_{2C}$, $M_{2C}$ may be expressed as Equation 13.

$$M_{2C} = [\beta^2 \cdot \{1 - Q(y)\}]_{0}^{\infty} = \frac{\beta^2}{2} \quad \text{(Equation 13)}$$

When M1 of Equation 6 obtained through Equations 7 to 9 and M2 of Equation 10 obtained through Equations 11 to 13 are applied to Equation 4, the MSE may be simplified as Equation 14.

$$MSE = \sigma^2 + \beta^2 - \frac{4\sigma\beta}{\sqrt{2\pi}} = \left(\beta - \frac{2\sigma}{\sqrt{2\pi}}\right)^2 + \sigma^2\left(1 - \frac{2}{\pi}\right) \quad \text{(Equation 14)}$$

As recognized from Equation 14, when $$\beta = \frac{2\sigma}{\sqrt{2\pi}},$$

the MSE has a minimum value $$\sigma^2\left(1 - \frac{2}{\pi}\right).$$

That is, the compensation value β may be appropriately set to $$\frac{2\sigma}{\sqrt{2\pi}}.$$

The controller 150 illustrated in FIG. 2 may output the compensation data CP_DATA based on the main compensation coefficient M_CV, the representative value RV, and the flag FG stored in the memory 140. The controller 150 may calculate the compensation value β based on the standard deviation $\sigma_1$ (see Equation 1) corresponding to the sub gradation B included in the representative value RV, and may include the compensation value β in the compensation data CP_DATA.

Although the sub compensation coefficient S_CV, the prediction compensation coefficient P_CV, the representative value RV, and the flag FG corresponding to the sub gradation B have been described with reference to FIGS. 4 to 9, the sub compensation coefficient S_CV, the prediction compensation coefficient P_CV, the representative value RV, and the flag FG may be obtained for the sub gradation A in the same manner.

Furthermore, the test apparatus TD may also obtain the sub compensation coefficient S_CV, the prediction compensation coefficient P_CV, the representative value RV, and the flag FG for sub gradations other than the sub gradations A and B as illustrated in FIG. 3 in the same manner. That is, the test apparatus TD may calculate the main compensation coefficient M_CV for one main gradation, and may store the flag FG and the representative value RV for one or more sub gradations in the memory 140.

A peak signal to noise ratio (PSNR) may be expressed as Equation 15.

$$PSNR \triangleq 10\log_{10}\left(\frac{\mathrm{MAX}^2}{MSE}\right) = 10\log_{10}\mathrm{MAX}^2 - 10\log_{10}MSE \quad \text{(Equation 15)}$$

When the compensation value β derived through Equations 4 to 14 is applied to the PSNR, a calculated PSNR* may be expressed as Equation 16.

$$PSNR^* = 10\log_{10}\mathrm{MAX}^2 - 10\log_{10}MSE\cdot\left(1 - \frac{2}{\pi}\right) = \quad \text{(Equation 16)}$$

-continued $$10\log_{10}\mathrm{MAX}^2 - 10\log_{10}MSE - 10\log_{10}\left(1 - \frac{2}{\pi}\right) = 10\log_{10}\mathrm{MAX}^2 - 10\log_{10}MSE + 4.3964 = PSNR + 4.3964$$

That is, it may be recognized that the calculated PSNR* theoretically increases by about 4.4 dB compared to the PSNR when the compensation value β is applied.

Figure 10:
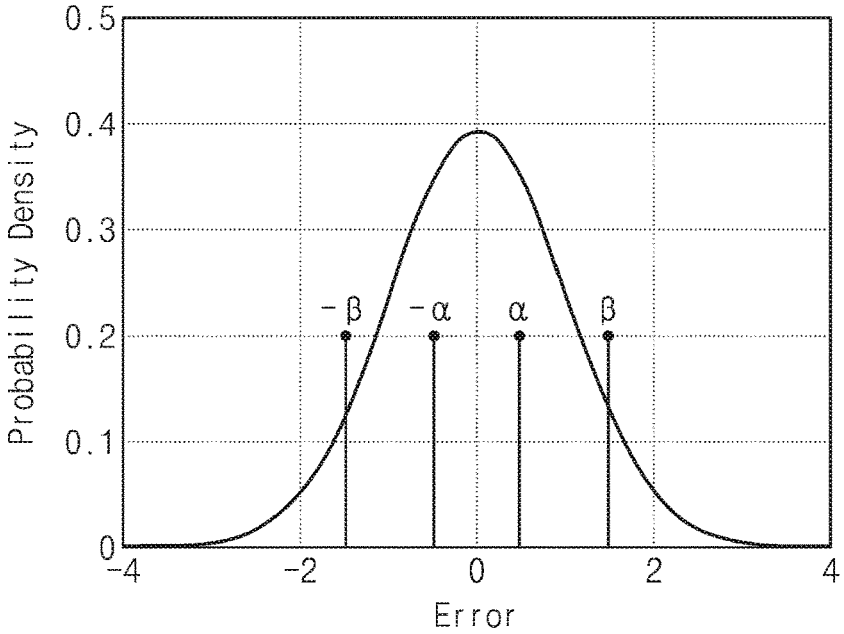
FIG. 10 is a graph illustrating a probability density and compensation values pertaining to an error between a prediction compensation coefficient and a sub compensation coefficient.

FIG. 10 is a graph illustrating a probability density and compensation values pertaining to the error N between the prediction compensation coefficient P_CV and the sub compensation coefficient S_CV.

Referring to FIGS. 2 and 10, the bit width of the flag bit B included in the flag FG may be 2. In this case, the compensation value may be one selected from among four compensation values +a, +β, −α, and −β.

According to one embodiment, the bit width of the flag bit B corresponding to a predetermined pixel is 2 bits, and the flag bit B may be one among 00, 01, 10, and 11 according to the difference between the sub compensation coefficient S_CV and the prediction compensation coefficient P_CV.

For example, when the prediction compensation coefficient P_CV is 10 and the sub compensation coefficient S_CV calculated by the compensation coefficient calculator 110 is 12, i.e., when the sub compensation coefficient S_CV is greater than the prediction compensation coefficient P_CV but the difference is less than a first threshold value (e.g., 3), a compensation value α may be added to the prediction compensation coefficient P_CV (10+α). In this case, the flag bit B may be 10.

When the prediction compensation coefficient P_CV is 10 and the sub compensation coefficient S_CV is 14, i.e., when the sub compensation coefficient S_CV is greater than the prediction compensation coefficient P_CV and the difference is greater than the first threshold value, a compensation value β may be added to the prediction compensation coefficient P_CV (10+β). In this case, the flag bit B may be 11.

When the prediction compensation coefficient P_CV is 10 and the sub compensation coefficient S_CV is 8, i.e., when the prediction compensation coefficient P_CV is greater than the sub compensation coefficient S_CV but the difference is less than the first threshold value, the compensation value α may be subtracted from the prediction compensation coefficient P_CV (10−α). In this case, the flag bit B may be 01.

When the prediction compensation coefficient P_CV is 10 and the sub compensation coefficient S_CV is 5, i.e., when the prediction compensation coefficient P_CV is greater than the sub compensation coefficient S_CV and the difference is greater than the first threshold value, the compensation value β may be subtracted from the prediction compensation coefficient P_CV (10−β). In this case, the flag bit B may be 00.

Although FIG. 10 illustrates that the threshold values for positive compensation and negative compensation are equal, for example, 3, the threshold values for positive compensation and negative compensation may be different from each other in another embodiment. For example, the compensation value β may be added to the prediction compensation coefficient P_CV (10+(3) when the different is 3 or greater (i.e., the first threshold value is 3) while the compensation value β may be subtracted from the prediction compensation coefficient P_CV (10−β) when the difference is 4 or greater (i.e., the second threshold value is 4). Likewise, the controller 150 may calculate a final compensation value for a sub gradation (e.g., the sub gradation A, the sub gradation B) by obtaining an optimum value of each of the compensation values $+\alpha$, $+\beta$, $-\alpha$, and $-\beta$ and adding the compensation values $+\alpha$, $+\beta$, $-\alpha$, and $-\beta$ corresponding to the flag bit B to the prediction compensation coefficient P_CV.

Figure 11:
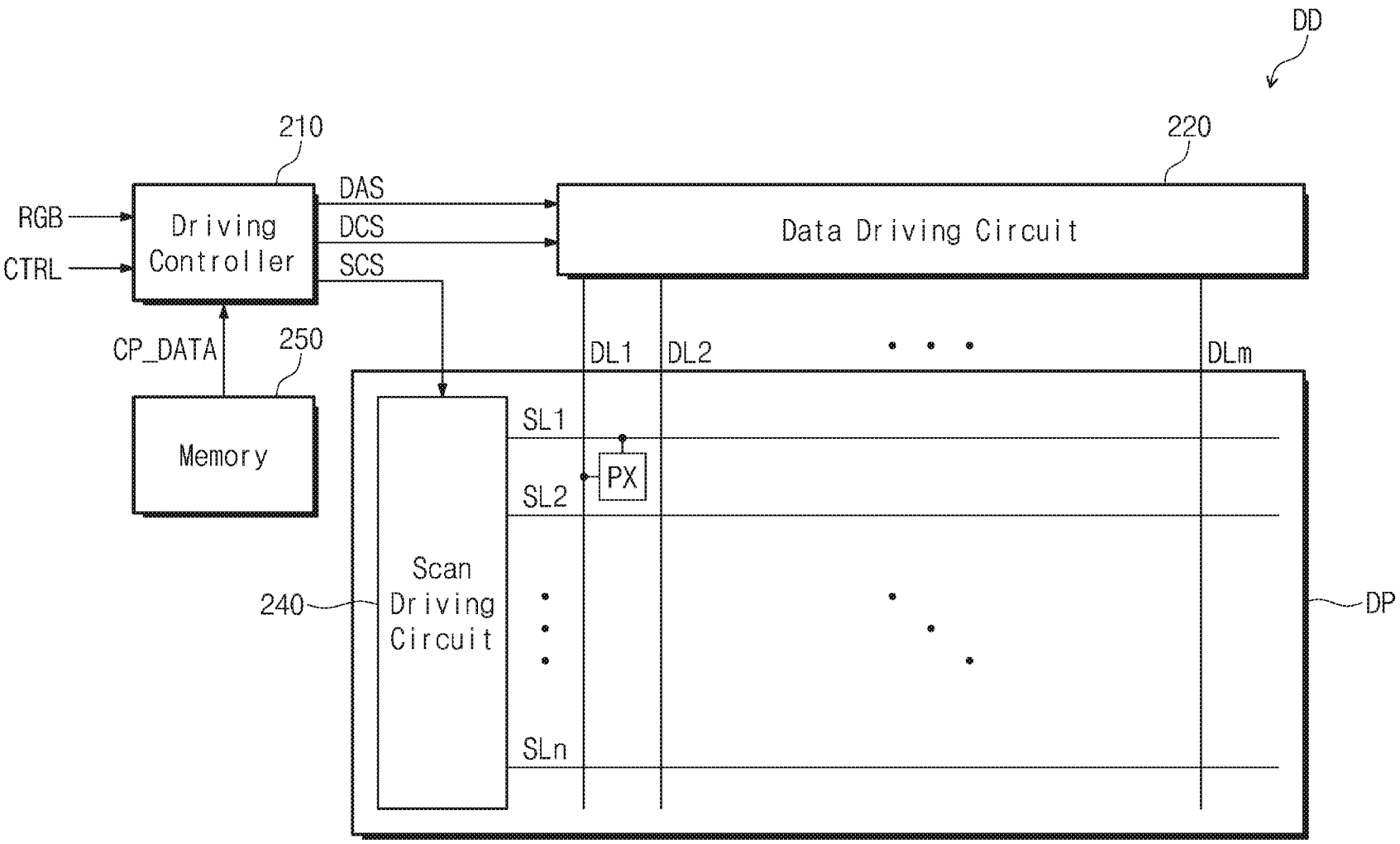
FIG. 11 illustrates a display device according to an embodiment of the present disclosure.

FIG. 11 illustrates the display device DD according to an embodiment.

Referring to FIG. 11, the display device DD includes the display panel DP, a driving controller 210, a data driving circuit 220, and a memory 250.

The display panel DP includes a scan driving circuit 240, a plurality of pixels PX, a plurality of data lines DL1 to DLm, and a plurality of scan lines SL1 to SLn. Each of the plurality of pixels PX is connected to a corresponding data line among the plurality of data lines DL1 to DLm, and a corresponding scan line among the plurality of scan lines SL1 to SLn.

The display panel DP that displays an image may be one of various types of display panels including, but not limited to, liquid crystal display (LCD) panel, electrophoretic display panel, organic light emitting diode (OLED) panel, light emitting diode (LED) panel, inorganic electro luminescent (EL) display panel, field emission display (FED) panel, surface-conduction electron-emitter display (SED) panel, plasma display panel (PDP), and cathode ray tube (CRT) display panel.

The driving controller 210 may externally receive an input image signal RGB and a control signal CTRL for controlling operation of the display panel DP that display an image corresponding to the input image signal RGB. The control signal CTRL may include at least one synchronization signal and at least one clock signal. The driving controller 210 may provide, to the data driving circuit 220, an image data signal DAS that is obtained by processing the input image signal RGB to satisfy an operation condition of the display panel DP. The driving controller 210 may provide a first control signal DCS to the data driving circuit 220 and provide a second control signal SCS to the scan driving circuit 240 based on the control signal CTRL. The first control signal DCS may include, but is not limited to, a horizontal synchronization start signal, a clock signal, and a line latch signal, and the second control signal SCS may include, but is not limited to, a vertical synchronization start signal and an output enable signal.

The data driving circuit 220 may output gradation voltages for driving the plurality of data lines DL1 to DLm in response to the first control signal DCS and the image data signal DAS that are received from the driving controller 210. In an embodiment of the present disclosure, the data driving circuit 220 may be implemented as an integrated circuit (IC), and it may be directly mounted in a predetermined region of the display panel DP, or may be mounted on a separate printed circuit board using a chip-on-film (COF) method to be electrically connected to the display panel DP. In another embodiment, the data driving circuit 220 may be formed on the display panel DP using the same process that forms a driving circuit (e.g., the scan driving circuit 240, the data driving circuit 220) of the display device DD.

The scan driving circuit 240 may drive the plurality of scan lines SL1 to SLn in response to the second control signal SCS that is received from the driving controller 210. In an embodiment of the present disclosure, the scan driving circuit 240 may be formed on the display panel DP using the same process as the driving circuit of the pixels PX, but the present disclosure is not limited thereto. For example, the scan driving circuit 240 may be implemented as an integrated circuit (IC), and it may be directly mounted in a predetermined region of the display panel DP, or may be mounted on a separate printed circuit board using a chip-on-film (COF) method to be electrically connected to the display panel DP.

The memory 250 may store the compensation data CP_DATA. The compensation data CP_DATA stored in the memory 250 may be provided from the test apparatus TD illustrated in FIG. 2. The compensation data CP_DATA may include the main compensation coefficient M_CV, the representative value RV, the flag FG, and the compensation value $\beta$.

The driving controller 210 may correct the externally provided input image signal RGB based on the compensation data CP_DATA stored in the memory 250, and may provide the image data signal DAS to the data driving circuit 220.

If the externally provided input image signal RGB corresponds to the main gradation M (see FIG. 3), the driving controller 210 may correct the input image signal RGB based on the main compensation coefficient M_CV corresponding to the main gradation M. If the externally provided input image signal RGB corresponds to the sub gradation B (see FIG. 3), the driving controller 210 may correct the input image signal RGB based on the representative value RV, the flag FG, and the compensation value $\beta$.

The driving controller 210 may calculate the prediction compensation coefficient P_CV according to Equation 17 similar to Equation 1.

$$G = \frac{G_0 - \mu_0}{\sigma_0} \times \sigma_1 + \mu_1 \quad \text{(Equation 17)}$$

In Equation 17, $G_0$, $\mu_0$, and $\sigma_0$ denote the main compensation coefficient M_CV, the mean, and the standard deviation corresponding to the main gradation M of a pixel, and G', $\mu_1$, and $\sigma_1$ denote the prediction compensation coefficient P_CV, the mean, and the standard deviation corresponding to the input image signal RGB for the pixel.

In Equation 17, $G_0$ denoting the main compensation coefficient M_CV and the representative values $\mu_0$, $\sigma_0$, $\mu_1$, and $\sigma_1$ may be provided from the memory 250.

The driving controller 210 may generate the image data signal DAS by adding the compensation value $\beta$ that is provided from the memory 250 to the calculated prediction compensation coefficient P_CV (denoted as G') as expressed by Equation 18.

$$DAS = G' + \beta \quad \text{(Equation 18)}$$

If the externally provided input image signal RGB corresponds to the sub gradation A (see FIG. 3), the driving controller 210 may correct the input image signal RGB based on the representative value RV, the flag FG, and the compensation value $\beta$.

If the externally provided input image signal RGB does not correspond to the main gradation M or the sub gradation B, the driving controller 210 may calculate the representative value RV corresponding to a gradation of the input image signal RGB based on the representative values ME_M and SD_M of the main gradation M and the representative values ME_B and SD_B of the sub gradation B. For example, the driving controller 210 may calculate the representative value corresponding to the gradation of the input image signal RGB using a linear interpolation method or spatial interpolation method. Furthermore, the driving controller 210 may apply the calculated representative value RV to Equations 17 and 18 to generate the image data signal DAS.

The test apparatus TD described above may provide, to the display device DD, the main compensation coefficient M_CV of the main gradation M for each pixel, and the representative value RV, the flag FG, and the compensation value β for each block as the compensation data CP_DATA.

The display device DD may generate compensation coefficients for all gradations of each of pixels using the main compensation coefficient M_CV, the representative value RV, the flag FG, and the compensation value β for each block. This may reduce the size of the memory 250 in comparison with a method of storing compensation coefficients for all gradations of each of pixels in the memory 250 of the display device DD.

Figure 12:
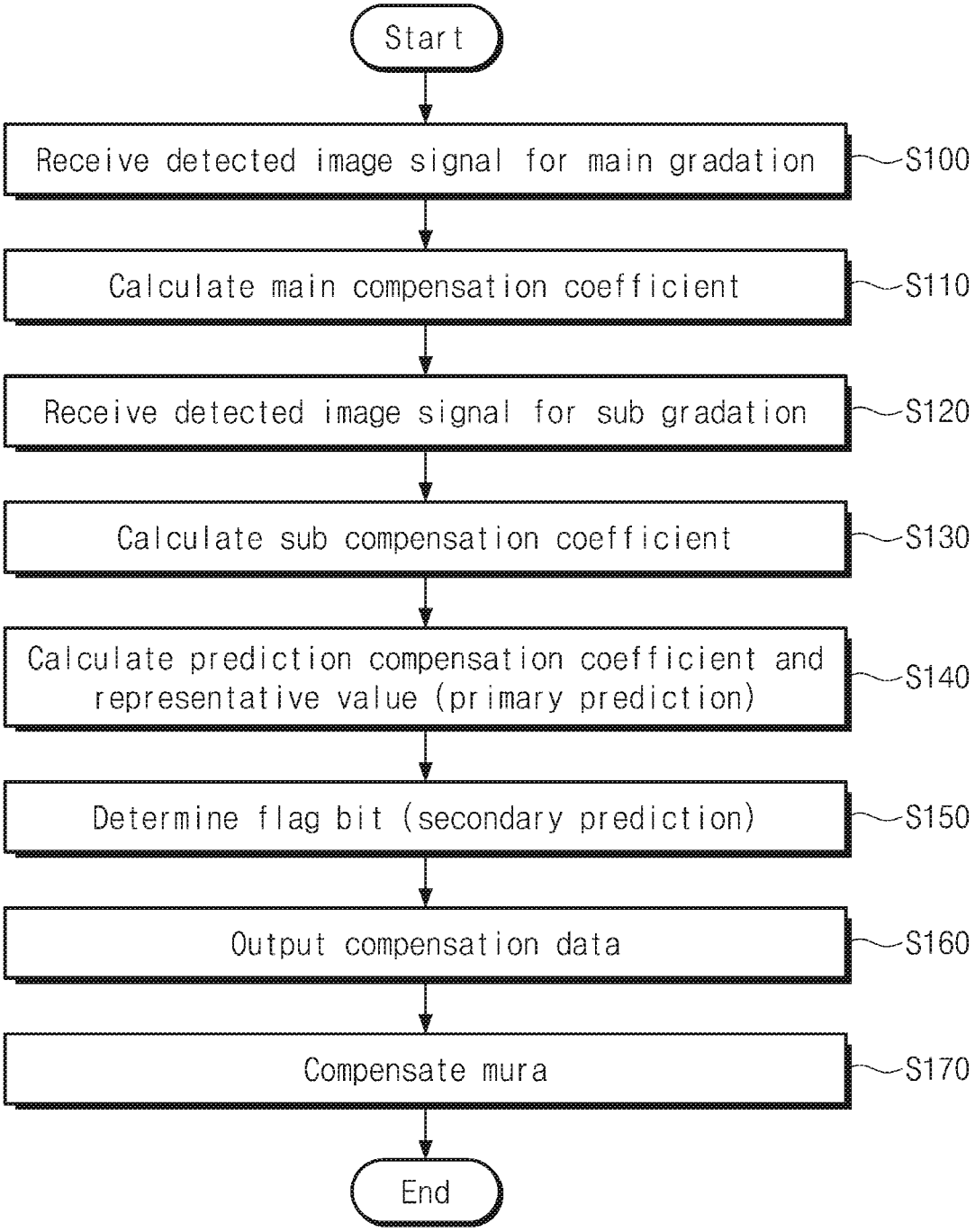
FIG. 12 is a flowchart illustrating a mura compensation method of the display device according to one embodiment.

FIG. 12 is a flowchart illustrating a mura compensation method of the display device DD according to one embodiment.

Referring to FIGS. 2, 11, and 12, the camera CAM may capture an image displayed on the display panel DP of the display device DD and provide the detected image signal IM to the test apparatus TD.

The compensation coefficient calculator 110 of the test apparatus TD may receive the detected image signal IM for the main gradation M (see FIG. 3) from the camera CAM (operation S100).

The compensation coefficient calculator 110 may calculate the main compensation coefficient M_CV (see FIG. 6) for each pixel based on the detected image signal IM (operation S110). The main compensation coefficient M_CV may be stored in the memory 140.

The compensation coefficient calculator 110 of the test apparatus TD may receive the detected image signal IM for the sub gradation B (see FIG. 3) from the camera CAM (operation S120). It is noted that the operations S100 and S120 may be performed in a reverse order or performed independently from each other or in parallel.

The compensation coefficient calculator 110 may calculate the sub compensation coefficient S_CV based on the detected image signal IM (operation S130). It is noted that the operations S110 and S130 may be performed in a reverse order or performed independently from each other or in parallel.

The primary predictor 120 may divide the display panel DP into a plurality of blocks, e.g., blocks BK11-BK16, BK21-BK26, BK31-BK36, and BK41-BK46 (see FIG. 5), and calculate the representative value RV of each of the blocks based on the detected image signal IM for each of the blocks. Furthermore, the primary predictor 120 may perform primary prediction for calculating the prediction compensation coefficient P_CV for a sub gradation based on the sub compensation coefficient S_CV and the representative value RV corresponding to each of the plurality of blocks (operation S140). The representative value RV may include a mean ME_M and a standard deviation SD_M corresponding to the main gradation M, and a mean ME_B and a standard deviation SD_B corresponding to the sub gradation B (see FIG. 7).

The secondary predictor 130 may perform secondary prediction for determining the flag bit B (see FIG. 8) of each pixel based on the sub compensation coefficient S_CV and the prediction compensation coefficient P_CV (operation S150). The flag FG including the flag bit B may be stored in the memory 140.

The controller 150 may output the compensation data CP_DATA based on the main compensation coefficient M_CV, the representative value RV, and the flag FG stored in the memory 140 (operation S160). The controller 150 may calculate the compensation value β based on a standard deviation $\sigma_1$ (see Equation 1) corresponding to the sub gradation B included in the representative value RV, and may include the compensation value β in the compensation data CP_DATA.

The driving controller 210 of the display device DD may compensation mura by correcting the externally provided input image signal RGB based on the compensation data CP_DATA stored in the memory 250, and may provide the image data signal DAS to the data driving circuit 220 (S170).

As described above, a plurality of pixels PX of the display panel DP may have different characteristics due to a process deviation. Even if image signals having the same gradation are provided to the pixels PX, the pixels PX may output light at different luminance levels. The display device DD according to an embodiment of the present disclosure may output the image data signal DAS that is obtained by correcting the input image signal RGB based on the compensation data CP_DATA stored in the memory 250. Therefore, the display device DD may prevent a mura effect that may be caused by deviation of the pixel characteristics.

The test apparatus TD having the above-described configuration may test a characteristic difference among pixels PX and generate compensation data corresponding to each pixel. In particular, a memory size may be reduced by performing secondary prediction for generating the flag FG for each pixel after primarily predicting the prediction compensation coefficient P_CV in a block-wise manner.

Although the embodiments of the present disclosure have been described, it is understood that the present disclosure should not be limited to these embodiments but various changes and modifications can be made by one ordinary skilled in the art within the spirit and scope of the present disclosure as hereinafter claimed.

What is claimed is:

1. A test apparatus comprising:

a compensation coefficient calculator configured to calculate a main compensation coefficient for a main gradation and a sub compensation coefficient for a sub gradation based on a detected image signal;

a primary predictor configured to divide a display panel into a plurality of blocks, determine a representative value of each of the plurality of blocks based on the detected image signal, and output a prediction compensation coefficient for the sub gradation based on the main compensation coefficient and the representative value corresponding to each of the plurality of blocks;

a secondary predictor configured to determine a flag based on the sub compensation coefficient received from the compensation coefficient calculator and the prediction compensation coefficient received from the primary predictor;

a memory configured to store the main compensation coefficient and the flag; and a controller configured to output compensation data comprising the main compensation coefficient, the representative value, and the flag stored in the memory.

2. The test apparatus of claim 1, wherein the representative value comprises a main mean and a main standard deviation corresponding to the main gradation of each of the plurality of blocks and a sub mean and a sub standard deviation corresponding to the sub gradation of each of the plurality of blocks.

3. The test apparatus of claim 2, wherein the controller determines a compensation value corresponding to the flag based on the sub standard deviation corresponding to the sub gradation, and wherein the compensation data further comprises the compensation value.

4. The test apparatus of claim 3, wherein the compensation value minimizes a mean squared error corresponding to the prediction compensation coefficient.

5. The test apparatus of claim 4, wherein the compensation value is $$\frac{2\sigma}{\sqrt{2\pi}},$$

where σ denotes the sub standard deviation corresponding to the sub gradation.

6. The test apparatus of claim 3, wherein a width of the flag is 1 bit, and wherein in a case where the prediction compensation coefficient is less than the sub compensation coefficient, the flag is 1, and the compensation value is a positive number.

7. The test apparatus of claim 3, wherein a width of the flag is 1 bit, and wherein in a case where the prediction compensation coefficient is larger the sub compensation coefficient, the flag is 0, and the compensation value is a negative number.

8. The test apparatus of claim 1, wherein the prediction compensation coefficient for the sub gradation is denoted as x' and obtained using an equation $$x' = \frac{x_0 - \mu_0}{\sigma_0} \times \sigma_1 + \mu_1,$$

and where $x_0$, $\mu_0$, and $\sigma_0$ denote the main compensation coefficient, a main mean, and a main standard deviation corresponding to the main gradation of a pixel, and $\mu_1$ and $\sigma_1$ denote a sub mean and a sub standard deviation corresponding to the sub gradation of the pixel.

9. A display device comprising:

a display panel comprising a plurality of pixels connected to a plurality of data lines and a plurality of scan lines;

a data driving circuit configured to drive the plurality of data lines;

a scan driving circuit configured to drive the plurality of scan lines;

a memory configured to store compensation data; and a driving controller configured to receive a control signal and an input image signal, control the data driving circuit and the scan driving circuit to display an image on the display panel, and provide, to the data driving circuit, an image data signal obtained by correcting the input image signal based on the compensation data, wherein the compensation data comprises a main compensation coefficient for a main gradation, a representative value for the main gradation, a representative value for a sub gradation, and a flag and a compensation value for the sub gradation.

10. The display device of claim 9, wherein the driving controller outputs the image data signal based on the main compensation coefficient in a case where the input image signal corresponds to the main gradation.

11. The display device of claim 9, wherein, in a case where the input image signal does not correspond to the main gradation, the driving controller determines a prediction compensation coefficient based on the main compensation coefficient, the representative value for the main gradation, the representative value for the sub gradation, the flag, and the compensation value, and outputs the image data signal based on the prediction compensation coefficient.

12. The display device of claim 11, wherein, in a case where the input image signal corresponds to the sub gradation, the driving controller determines the prediction compensation coefficient denoted as G' using an equation $$G = \frac{G_0 - \mu_0}{\sigma_0} \times \sigma_1 + \mu_1,$$

and where $G_0$, $\mu_0$, and $\sigma_0$ denote the main compensation coefficient, a main mean, and a main standard deviation corresponding to the main gradation, and $\mu_1$ and $\sigma_1$ denote a sub mean and a sub standard deviation corresponding to the input image signal.

13. The display device of claim 12, wherein the driving controller outputs the image data signal by adding the compensation value to the prediction compensation coefficient.

14. A method comprising:

receiving a detected image signal for a main gradation and determining a main compensation coefficient for the main gradation;

receiving the detected image signal for a sub gradation and determining a sub compensation coefficient for the sub gradation;

performing primary prediction by dividing a display panel into a plurality of blocks, determining a representative value for each of the plurality of blocks, and determining a prediction compensation coefficient for the sub gradation based on the representative value and the main compensation coefficient;

performing secondary prediction by determining a flag based on the sub compensation coefficient and the prediction compensation coefficient;

providing compensation data comprising the main compensation coefficient, the representative value, and the flag; and providing an image signal that is obtained by correcting an input image signal based on the compensation data and displaying an image based on the image signal.

15. The method of claim 14, wherein the representative value comprises a main mean and a main standard deviation corresponding to the main gradation of each of the plurality of blocks and a sub mean and a sub standard deviation corresponding to the sub gradation of each of the plurality of blocks.

16. The method of claim 15, wherein the outputting of the compensation data comprises determining a compensation value corresponding to the flag based on the sub standard deviation corresponding to the sub gradation, and wherein the compensation data further comprises the compensation value.

17. The method of claim 16, wherein the compensation value minimizes a mean squared error corresponding to the prediction compensation coefficient.

18. The method of claim 17, wherein the compensation value is $$\frac{2\sigma}{\sqrt{2\pi}},$$

where σ denotes the sub standard deviation corresponding to the sub gradation.

19. The method of claim 16, wherein a width of the flag is 1 bit, and wherein the performing of the secondary prediction comprises:

setting the flag to 1 in a first case where the prediction compensation coefficient is less than the sub compensation coefficient; and setting the flag to 0 in a second case where the prediction compensation coefficient is larger than the sub compensation coefficient.

20. The method of claim 14, wherein the prediction compensation coefficient for the sub gradation is denoted as x' and obtained using an equation $$x' = \frac{x_0 - \mu_0}{\sigma_0} \times \sigma_1 + \mu_1,$$

and where $x_0$, $\mu_0$, and $\sigma_0$ denote a main compensation coefficient, a main mean, and a main standard deviation corresponding to the main gradation of a pixel, and $\mu_1$ and $\sigma_1$ denote a sub mean and a sub standard deviation corresponding to the sub gradation of the pixel.

* * * * *